US006199709B1

(12) United States Patent
Rössler

(10) Patent No.: US 6,199,709 B1
(45) Date of Patent: Mar. 13, 2001

(54) ACTUATING DEVICE

(76) Inventor: Elfriede Rössler, Jakob-Auer-Strasse 8, A-5033 Salzburg (AT)

( * ) Notice: Subject to any disclaimer, the term of this patent is extended or adjusted under 35 U.S.C. 154(b) by 0 days.

(21) Appl. No.: 09/325,265

(22) Filed: Jun. 3, 1999

(30) Foreign Application Priority Data

Jun. 4, 1998 (AT) ..... 959/98

(51) Int. Cl.[7] ..... B61G 3/06
(52) U.S. Cl. ..... 213/75 D; 213/211; 213/212; 213/75 TC
(58) Field of Search ..... 213/211, 212, 213/75 TC, 75 D

(56) References Cited

U.S. PATENT DOCUMENTS 4,195,742 * 4/1980 Yumoto ..... 213/75 TC
4,219,123 * 8/1980 Saeki ..... 213/75 TC
4,893,716 * 1/1990 Diller ..... 213/213

FOREIGN PATENT DOCUMENTS

3939528 * 9/1990 (DE) ..... 213/75
40 15 005 A1 11/1991 (DE) .
19612263 C1 3/1997 (DE) .
298 03 511 U1 6/1998 (DE) .
62-268348 11/1987 (JP) .
9-163709 6/1997 (JP) .
09163709 * 6/1997 (JP) ..... H02K/33/18

OTHER PUBLICATIONS

Viessmann Catalog, p. 5 (Technologie die begeistert).

* cited by examiner

*Primary Examiner*—S. Joseph Morano
*Assistant Examiner*—Frantz F. Jules
(74) *Attorney, Agent, or Firm*—Alston & Bird LLP

(57) ABSTRACT

The invention relates to an actuating device (1), in particular a drive (2), preferably for sequences of motion in the field of model building, with at least one magnetic field producing component (11, 32), in particular a coil (12, 33), for producing a magnetic field and an adjusting member (3) adjustable relative to a main body, which are adjustable relative to one another on electrically charging the coil (12, 33). The magnetic force for producing the relative movement is increased in the direction of the relative movement between the coil (12) and the adjusting member (3) and/or the main body (4).

26 Claims, 10 Drawing Sheets

ACTUATING DEVICE

BACKGROUND OF THE INVENTION

1. Field of the Invention

The invention relates to an actuating device, in particular drive, preferably for sequences of motion in the field of model building, with at least one magnetic-field producing component, in particular a coil, for generating a magnetic field and an adjusting member that is adjustable relative to a main body, which can both be adjusted relative to one another on the charging of the coil and a coupling device, in particular for a model railway vehicle, comprising a main housing and at least one retainer and/or a pivot lever.

2. The Prior Art

An actuating device, in particular a coupling device for model railways for automatically connecting and disconnecting two model vehicles with a locking element and at least one coupling head is already known according to DE 196 12 263 C1. Said coupling device comprises a coupling head, which engages in a recess of the coupling device, the coupling heads being in contact electrically and being designed as electrically conductive contact strips. Using this design a simple conductive connection is indeed produced between the individual vehicles of a train system in a model railway, but additional manipulation is required for separating the coupling devices of two model railway vehicles from one another.

Furthermore, a drive in the form of an actuating device which has two magnetic coils is known from the 97/98 catalogue of the company Viessman, p.5, wherein spiral springs transfer the force of the magnetic coils to a brake piston. The brake piston here has a damping effect on the drive. The disadvantage of this drive is primarily the complicated construction. In addition, this drive is not suitable for all movements.

Experiments with modern technological materials have also been carried out, such as multi-layer materials or memory metals as well as elements of the type known from sensor technology to piezo-elements. Since the costs of the development and also of acquiring the parts are very high, their use in the sphere of model construction is still at least presently not possible.

SUMMARY OF THE INVENTION

The objective of the present invention is to create an actuating device, in particular a drive for movement sequences, in which with a simple structure a high adjusting force is obtained. The objective of the invention is also to create coupling devices which, when arranged at any point on the train system of a model railway, enable the coupling connection between two such coupling devices to disconnect automatically.

Said objective of the invention is achieved in that the magnetic force for producing the relative movement is increased in the direction of the relative movement between the coil and the adjusting member and/or the main body. It is advantageous here that in this way a lower structural height for such an activating device with equal adjusting force can be created, and thus the use of such an actuating device is possible in microsystems and miniaturised motion sequences. A further advantage is that, on the restoring of the actuating device, in particular the adjusting member, the same adjusting force is available, so that the adjusting member can always be returned to its position of rest.

It is also advantageous that conventional components can be used and thus the cost of manufacturing the actuating device can be kept low.

Other advantages are that by a single charge of the magnetic-field producing component with power an attraction force and a repulsion force can be created simultaneously.

It is also advantageous, when the adjusting member of the actuating device forms a coupling part for a coupling device of model vehicles, in particular a model railway vehicle, as thereby an inexpensive production of coupling devices for model railway vehicles is possible.

A further advantage is that different forces for the attraction force and repulsion force can be created.

Furthermore, the invention also comprises a coupling device, in particular for a model railway vehicle, comprising a main housing and at least one retainer and/or a pivot lever.

Said coupling device, in which the coupling device is assigned an actuating device, is advantageous, because by the arrangement of the actuating device in the coupling device of a model railway vehicle at any given point, the detachment of a coupling connection between two model railway vehicles is possible by using at least one such coupling device.

In addition it is advantageous, that a considerable increase in the adjusting force is achieved.

Furthermore, an electrically remote-controlled coupling device between model vehicles, in particular between model railway, is important, as hereby a coupling connection can be formed between identical coupling heads and then broken by remote control. To break the coupling connection it is merely necessary to activate only one of the two electromagnetic drives or actuating devices, in order to detach the so-called double locking coupling connection or the double hook coupling. This is achieved in that the electromagnetic drive of one of the two coupling devices is coupled in motion with the corresponding coupling parts of the other, assigned coupling device.

Lastly, it is advantageous, when a pivoting or restricted rotary drive is created for detaching a coupling connection between model railway vehicles, which has high functional safety and permits relatively high adjustment movements at high adjusting force.

BRIEF DESCRIPTION OF THE DRAWINGS

The invention is explained in more detail in the following by way of embodiments shown in the drawings.

Shown are.

DETAILED DESCRIPTION OF PREFERRED EMBODIMENTS

First of all, it should be noted that in the different described embodiments the same parts are allocated the same reference numbers or same component names, whereby the disclosing contained throughout the description can be applied in meaning to the same parts with the same reference numbers or same component names. Also the details of position used in the description, such as e.g. top, bottom, side etc. relate to the Figure being described at the time and with a change of position should be applied to the new position. Furthermore, individual characteristics or combinations of characteristics from the illustrated and described different embodiments can form independent, inventive solutions according to the invention.

Figure 2:
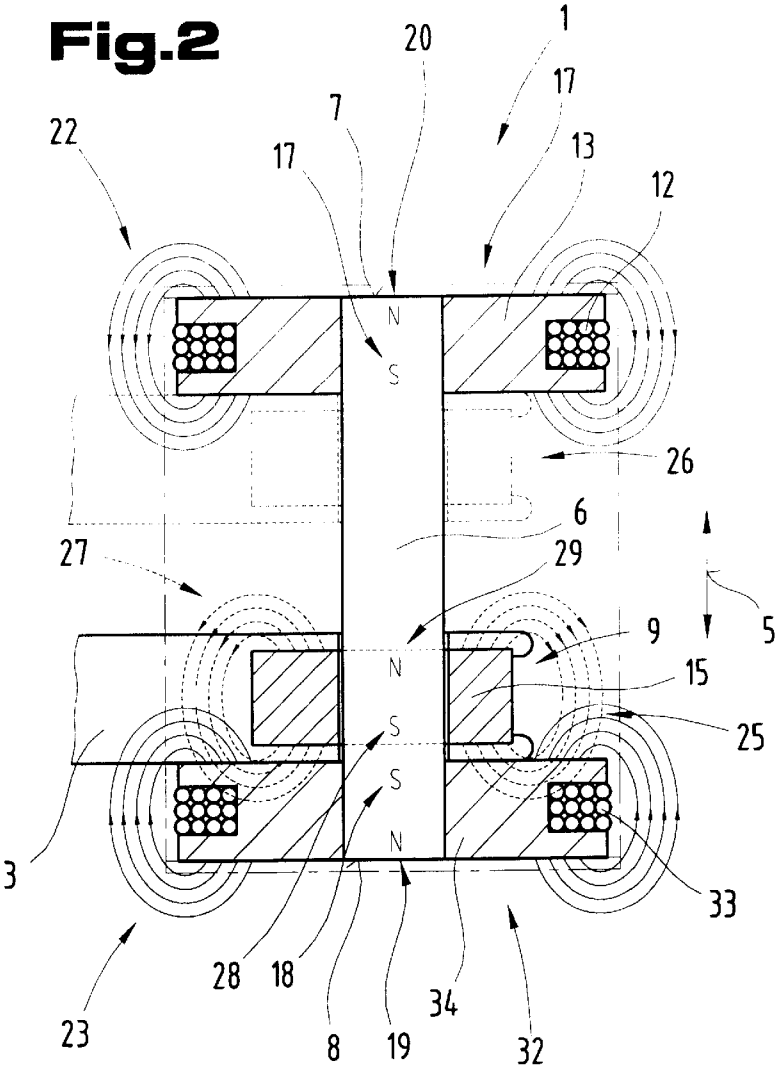
FIG. 2 a different embodiment in the form of a diagram of the actuating device according to the invention in a simplified, schematic view.
Figure 1:
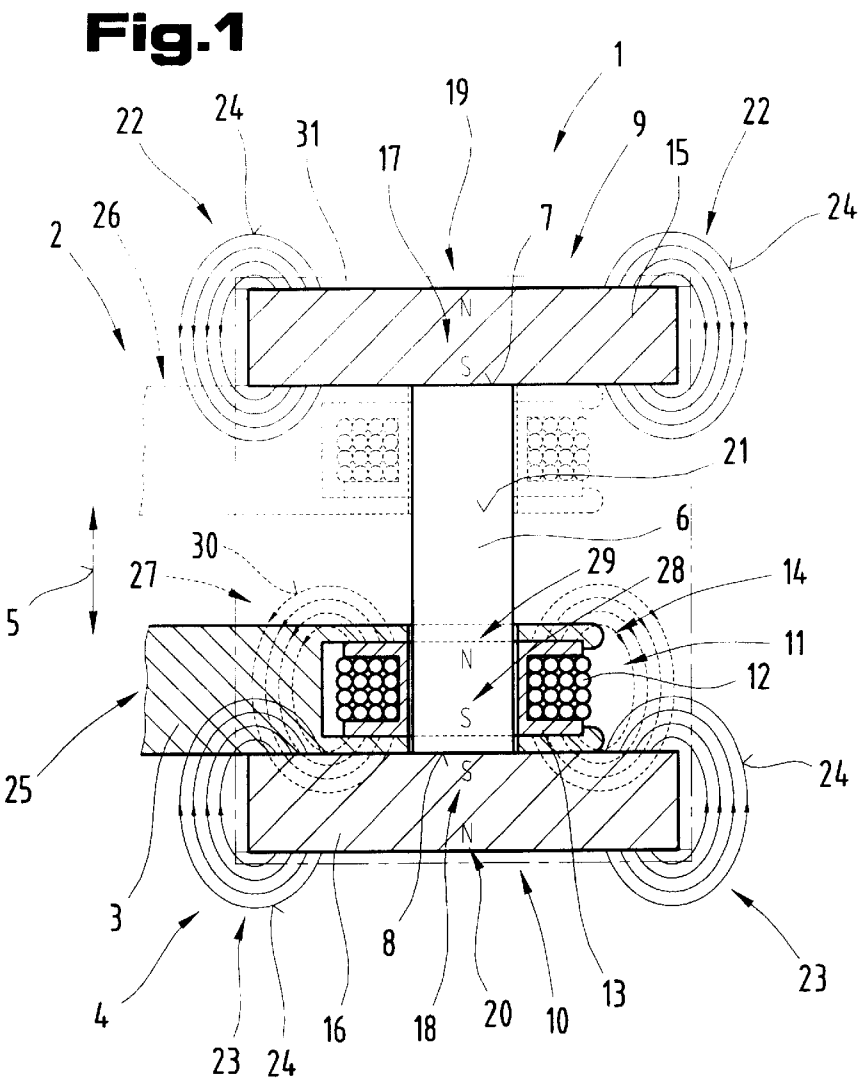
FIG. 1 a diagram of the actuating device according to the invention in a simplified schematic view.
Figure 3:
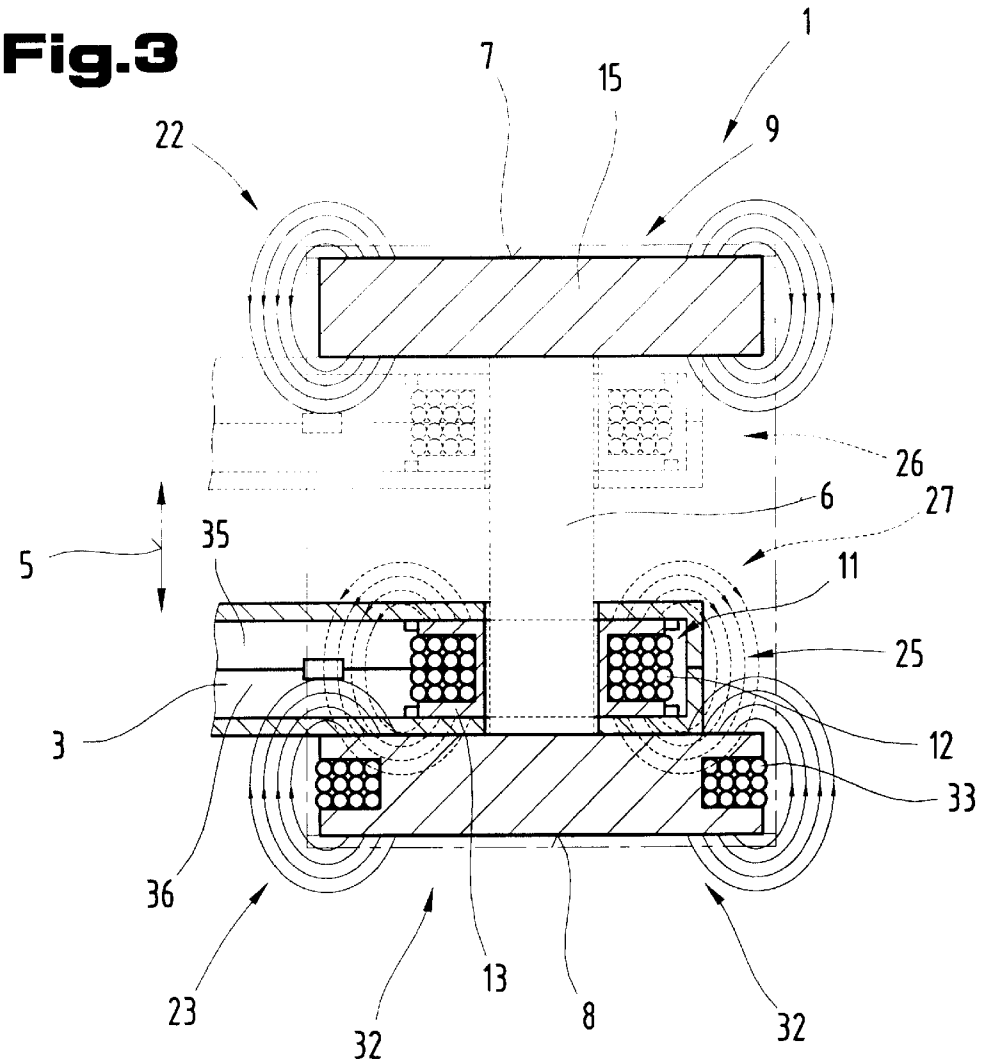
FIG. 3 a further embodiment in the form of diagram of the actuating device according to the invention in a simplified, schematic view.

In FIGS. 1 to 3 different embodiments of an actuating device 1 are shown in the form of a diagram.

In FIG. 1 an embodiment of the actuating device 1 is shown in which the actuating device 1 acts as a drive 2 for an adjusting lever or an adjusting member 3, whereby the latter can preferably be used in microsystems and miniaturised motion sequences and motion sequences in model building. The actuating device 1 has a main body 4 and the adjusting member 3 mounted in the main body 4, whereby a motion sequence of the adjusting member 3 can be performed according to a shown arrow 5.

The main body 4 of the actuating device 1 is in the form of a guide web 6 and two magnetic adjusting elements 9, 10 arranged at the two opposite ends 7, 8, of the guide web 6. Furthermore, the actuating device 1 comprises a magnetic field producing component 11 which is mounted movably on the guide web 6. The magnetic field producing component 11 is preferably in the form of a coil 12 with a coil body 13, whereby the magnetic field producing component 11 is connected with the adjusting member 3 for example by a preferably detachable connection 14, which is arranged on the adjusting member 3, whereby with a movement of the magnetic-field producing component 11 the adjusting member 3 is moved along the guide web 6. The design, in particular the form of the main body 4 or the individual parts, such as the guide web 6, the magnetic adjusting elements 9, 10 and the magnetic-field producing component 11 can be of any shape e.g. square, circular, quadratic etc.

So that the magnetic-field producing component 11 can be charged with energy it is possible for example that on an end face of the coil body 13 connection points of coil wires of the coil 12 are provided, so that via a connection cable a connection of the coil 12 to an energy source can be made. Of course, it is possible that any system known from the prior art for supplying or feeding a coil 12 with power can be used.

In the actuating device 1 according to the invention the magnetic adjusting elements 9, 10 are in the form of permanent magnets 15, 16, whereby the permanent magnets 15, 16 are arranged at the ends 7, 8 of the guide web 6 in such a way that for example a south pole 17, 18 forming the permanent magnets 15, 16, which is marked in the Figure by the abbreviation "S", faces the guide web 6 or is allocated thereto, i.e. the permanent magnets 15, 16 are arranged at the ends 7,8 of the guide web 6 so that an identical pole of the permanent magnet, for example the south pole 17, 18 faces the guide web 6 or is aligned in the direction of the guide web 6. The other pole, namely a north pole 19, 20 of each permanent magnet 15, 16, which is marked in the Figure by the abbreviation "N", extends in the opposite direction to the south pole 17, 18. With such an arrangement of the permanent magnets 15, 16 with opposite poles, namely south poles 17, 18, it is achieved that the adjusting member 3 mounted movably on the guide web 6 in magnetic fields, which are formed by the two permanent magnets 15, 16, is arranged with the same polarity, and thus no attention needs to paid to the installation direction of such an actuating device 1.

It is also possible that by using the coil 12 as a magnetic-field producing component 11 the guide web 6 can be designed as a coil core 21, so that a corresponding concentration of the magnetic field lines of a magnetic field produced by the coil 12 is achieved. So that the guide web 6 can be used as a coil core 21, the guide web 6 is made of a metal material, namely iron, so that as known from the prior art, an increase in magnetic force increase is obtained, i.e. so that thus a coil 12 with an iron core is used as a magnetic field producing component 11.

By means of the arrangement of two magnetic adjusting elements 9, 10, in particular the permanent magnets 15, 16, a permanent magnetic field 22, 23 is formed. The magnetic fields 22, 23 of the permanent magnets 15, 16 are designed to be identical in relation to the adjusting member 3, i.e. the magnetic field lines 24 of the two magnetic fields 22, 23, as shown in FIG. 1, are formed from north pole 19, 20 to south pole 17, 18 and thus enter into the adjusting member 3. Of course, it is possible that the permanent magnets 15, 16 are arranged at the ends of the guide web 6 so that the north poles 19, 20 are facing the magnetic fields 22, 23 in the direction of the guide web 6 or the adjusting element 3.

In the shown embodiment of the actuating device 1 the adjusting member 3 is shown in a position of rest 25 by solid lines, whereas the working position 26 of the adjusting member 3 is shown by broken lines.

So that now a movement from the position of rest 25 to the working position 26, according to the arrow 5, can be performed with the adjusting member 3, the magnetic field producing component 11, in particular the coil 12, is charged with energy. By means of charging the magnetic field producing component 11 with energy an additional magnetic field 27, as shown by broken lines, is produced, with a south pole 28 and a north pole 29. With this magnetic field 27 magnetic field lines 30 are formed from the north pole 29 in the direction of the south pole 28. The two poles, in particular the south pole 28 and the north pole 29 are formed in the shown Figure by the abbreviations "S" and "N".

In order that a lifting movement of the adjusting member 3 from the magnetic adjusting element 10 assigned to the adjusting member 3, in particular the permanent magnet 16, can be made electricity flows through coil 12, so that the south pole 28 formed by the magnetic field 27 in the direction of the permanent magnet 16 is assigned to the adjacent or adjoining magnetic adjusting element 10. The other pole, namely the north pole 29 is formed opposite, so that said north pole 29 is assigned to the further removed, magnetic adjusting element 9. As now two identical poles, in particular the south poles 18 and 28, are aligned relative to one another, a repulsion effect or a repulsion force of the adjusting member 3 from the position of rest 25 is produced i.e. due to the opposite running magnetic field lines 24, 30 a repulsion force is generated, so that the adjusting member 3 is moved from its position of rest 25 in the direction of the working position 26 of permanent magnet 16.

Furthermore, by the arrangement of the additional magnetic adjusting element 9 with a further alignment of its south pole 17 in the direction of the adjusting member 3 an attraction force for the movement of the adjusting member 3 from the position of rest 25 into the working position 26 is created, as now two opposite poles, in particular the south pole 17 of the permanent magnet 15 and the north pole 29 of the magnetic field producing component 11 are aligned relative to one another. In this way it is achieved that in addition to the repulsion force at the same time an attraction force of the opposite permanent magnet 15 acts on the adjusting member 3 and thus an additional support is created by the effect of further force for the motion sequence, according to arrow 5, from the position of rest 25 into the working position 26 of the adjusting member 3.

If after a completed movement of the adjusting member 3 into the working position 26 the coil 12, in particular the magnetic field producing component 11, is further charged with energy, in particular with current and voltage, a securing of the adjusting member 3 in the working position 26 takes place, i.e. the adjusting member 3 is held in the working position 26 by the formation of the attraction force between the two magnetic fields 22 and 23 and thus a return of the adjusting member 3 into the position of rest 25 is avoided. If the actuating device 1 is used in vertical direction to the earth's surface on a deactivation of the energy flow through the coil 12 the magnetic field 27 of the coil 12 is ended, and thus due to gravitational force an automatic return of the adjusting member 3 into the position of rest 25 is performed. With a horizontal use of the actuating device 1 an automatic return of the adjusting member 3 into the position of rest 25 is possible, if by cutting the power supply to the magnetic field producing component 11 the magnetic field 27 is extinguished, and thus no further attraction force acts on the adjusting member 3, whereby an external force is exerted e.g. by a spring on the adjusting member 3, whereby an automatic return into the position of rest 25 is achieved.

It can now be said that for a motion sequence of the adjusting member 3 according to the arrow 5 the polarity of the magnetic field 27 on charging the magnetic field producing component 11 relative to the magnetic field 23 of the adjacent permanent magnet 16 or 15 in a position of rest, a repulsion force is created in the direction of the working position 26, and at the same time by the remote lying permanent magnet 15 an attraction force is created so that a rapid adjusting procedure for the adjusting member 3 is achieved from the position of rest 25 into the working position 26 or vice versa. Furthermore, it is achieved in this way that the adjusting member 3 can exert a corresponding high adjusting force, so that movably mounted parts, which are connected with the adjusting member 3 or which lie on the adjusting member 3 or are in contact with the latter can be moved, as is the case for example with a coupling bar of a model railway.

So that the adjusting member 3 can be moved back out of the working position 26 into the position of rest 25, it is possible to perform a reversal of current through the coil 12, in particular the magnetic field producing component 11, whereby the polarity of the magnetic field 27 is reversed and thus a repulsion force and attraction force are produced in the opposite direction, i.e. so that the adjusting member 3 is pushed away from the working position 26 by the adjacent magnetic adjusting element 9 by the repulsion force and at the same time by the formation of the attraction force with the magnetic adjusting element 10 is attracted by the latter, and thus in turn the complete adjusting force of the adjusting member 3 is available for the return.

By means of such a design of actuating device 1 it is also possible, that the actuating device 1 can be used in a horizontal direction to the earth's surface or at any angle to the earth's surface, as for the motion sequence of the adjusting member 3 according to the arrow 5, that is on the movement from the position of rest 25 to the working position 26 and from the working position 26 into the position of rest, by a corresponding flow of current through the coil 12, a repulsion force and attraction force are always exerted on the adjusting member 3.

Furthermore, it is achieved that the actuating device 1 can have a low structural height and at the same time there is a relatively high adjusting force for the adjusting member 3, whereby it is now possible to install such an actuating device 1 for example in a coupling device of a model railway to move one or more parts. Such embodiments are explained in more detail below in FIGS. 4 to 10. Of course, it is possible that such an actuating device 1 can also be used in other areas, for example for a points operating drive of a model railway, microsystem applications or for miniaturised motion sequences.

Furthermore, it is possible in the shown embodiments, that by means of corresponding arrangements of magnetic field supporting components or materials, such as for example a housing, the main body 4 of the actuating device 1 is surrounded fully or partly. By means of such an arrangement of a housing around the permanent magnets 15, 16, in particular the main body 4 of the actuating device 1, a concentration or alignment of the individual magnetic fields 22, 23 and 27 is created so that on the inside of the main body 4, that is in the adjusting region of the adjusting member 3 a concentration of the magnetic field lines 24, 30 is achieved, and thus an even better and greater adjusting force can be created for the adjusting member 3. It is possible in this case that as shown schematically by broken lines, a rear closing plate 31 is arranged around the magnetic adjusting elements 9, 10, in particular around the periphery of the main body 4.

By means of this rear closing plate 31 it is also achieved that the magnetic fields 22, 23 and 27, in particular their magnetic field lines 24, 30, do not run outside the rear closing plate 31, but that the latter on leaving the north poles 19, 20 of the magnetic fields 22, 23 enter directly into the rear closing plate 31, and in the adjustment region of the adjusting member 3, that is between the position of rest 25 and the working position 26 of the adjusting member 3, exit again from the rear closing plate 3 1. An additional advantage is that the actuating device 1 can also be used in areas with magnetic field sensitive components, as no magnetic field lines 24, 30 are found outside the rear closing plate 31 and thus interference is prevented.

In FIG. 2 a different schematic structure of the actuating device 1 is shown, whereby the main principle of the function sequence corresponds to the embodiment according to the FIG. 1.

The difference to the embodiment of the actuating device 1 described in FIG. 1 is that here only one magnetic adjusting element 9 in the form of the permanent magnet 15 is provided, whereby said magnetic adjusting element 9 is now arranged in the adjusting member 3 instead of the magnetic field producing component 11. The magnetic adjusting element 9 or the adjusting member 3 is in turn mounted movably on the guide web 6, so that in turn an adjusting of the adjusting member 3 from the position of rest 25 shown by solid lines into the working position 26 shown by broken lines is possible.

At the ends 7, 8 of the guide web 6, in particular in the end regions of the guide web 6, here two magnetic field producing components 11 and 32 are arranged. Here it is possible that the guide web 6 forms the core of the two magnetic field producing components 11 and 32, whereby the guide web 6 is inserted into the inside of the magnetic field producing components 11 and 32. The two magnetic field producing components 11, 32 are now formed by the coil 12 with the coil body 13 and a further coil 33 with a further coil body 34.

With this structure of the actuating device I the individual components necessary for the movement sequence, according to the arrow 5, of the adjusting member 3, are exchanged or replaced. The method of adjusting the adjusting member 3 corresponds to the method described in FIG. 1, i.e. for adjusting the adjusting member 3 from the position of rest 25 to the working position 26 a repulsion force and an attraction force are exerted on the adjusting member 3. For this the two magnetic field producing components 11, 32 are charged with energy, so that the magnetic fields 22, 23, are formed as described in FIG. 1. The two magnetic field producing components 11, 32, in particular the coils 12, 33, are operated or driven with the same polarity of energy, so that same poles of the two magnetic fields 22, 23 are aligned relative to one another. As now the permanent magnet 15, in particular the magnetic adjusting element 9, is arranged in the adjusting member 3, a repulsion force and an attraction force is formed on the adjusting member 3, whereby a rapid adjustment of the adjusting member 3 with a very high adjusting force from the position of rest 25 into the working position 26 or vice versa is made possible. For the return of the adjusting member 3 it is merely necessary to reverse the polarity of the energy supply of the two coils 12 and 33, so that for the return a repulsion force and attraction force are exerted on the adjusting member 3.

The advantage of such a design of actuating device 1 is that by the arrangement of the magnetic field producing components 11 and 32 at the ends 7, 8 of the guide web 6 the latter can be larger in size, so that the magnetic force of the magnetic fields 22, 23 can be increased, without an enlargement of the adjusting member 3 having to be made. This is an advantage in so far as thereby the actual weight of the adjusting member 3 can be kept as low as possible, whereas an increase in the magnetic field and greater adjusting force can be achieved by using magnetic field producing components 11, 32 of larger dimensions.

Of course, it is possible that with such an actuating device 1 both magnetic field producing components 11, 32 do not have to be charged with energy at the same time, and a consecutive drive of the two magnetic field producing components 11, 32 is possible. In this way it is achieved that firstly the repulsion force is created between the adjusting member 3 and the magnetic field producing component 32, whereby subsequently by charging the other magnetic field producing component 11 the attraction force is created between the magnetic field producing component 11 and the adjusting member 3.

Furthermore, it is also possible that by means of the opposite control of the two magnetic field producing components 11 and 32 a floating state of the adjusting member 3 can be achieved, i.e. the adjusting member 3 is repulsed by the repulsion force created between the magnetic field producing component 32 and the adjusting member 3 from the position of rest, whilst at the same time by the creation of a further repulsion force by the other magnetic field producing component 11 the adjusting member 3 is held between a position of rest and working position 26 by the two acting repulsion forces. In this way it is possible that with this kind of actuating device 1 three different positions of the adjusting member 3 can be achieved.

In FIG. 3 a further embodiment of the structure of such an actuating device 1, as illustrated in the above described FIGS. 1 and 2, is shown. The functional sequence for a movement of the adjusting member 3 corresponds to that of the previously described FIGS., i.e. in that both a repulsion force and an attraction force act on the adjusting member 3 for the movement sequence.

In these embodiments of the actuating device 1 a magnetic field producing component 11 is arranged in the adjusting member 3. The adjusting member 3 is here comprised of two parts 35, 36, so that the magnetic field producing component 11 is inserted into the inner chamber of the two parts 35, 36. By means of such a design of the adjusting member 3 it is achieved, that the latter has a hollow cavity, whereby the weight of the adjusting member 3 can be reduced.

At both ends 7, 8 of the guide web 6 on one side a magnetic adjusting element 9 is arranged, in particular at the end 7 of the guide web 6, and at the other end 8 a magnetic field producing component 32 is arranged. By means of this embodiment it is possible that by a corresponding charging of the magnetic field producing components 11, 32 with energy a repulsion force is created in the position of rest 25 of the adjusting member 3, whereas at the same time by means of the magnetic adjusting element 9 an attraction force can be created for the working position 26 or vice versa. The method for creating the individual magnetic fields 22, 23 and 27 can be taken from the FIGS. described above.

For the Figures described above it should be mentioned that for the formation of the repulsion force two equal poles of two magnetic fields 22, 23 or 27 have to be aligned relative to one another, whereas for the attraction force two opposite poles of two magnetic fields 22, 23 or 27 have to be aligned relative to one another. As because of the use of magnetic field producing components 11, 32 for the latter with corresponding current flow through the magnetic field producing components 11, 32, the polarity of the magnetic fields 22, 23 or 27 can be influenced, it is possible that at any time a repulsion force and an attraction force can be created together. It is also possible to use any combination of the magnetic adjusting elements 9 and 10 and the magnetic field producing components 1 and 32.

In this embodiment is also possible that on the arrangement of the magnetic adjusting element 9 at the end 8 or 7, at which the adjusting member 3 has its position of rest 25, due to the charging of the two other magnetic field producing components 11, 32 with opposite current a floating state of the adjusting element 3 can be produced. Furthermore, it is possible that instead of the magnetic adjusting elements 9 and/or 10 a further magnetic field producing component 11, 32 can be used. It is also possible instead of a permanent magnet 15, 16 in the adjusting member 3 to arrange a metal part, so that by charging two magnetic field producing components 11, 32 an adjustment of the adjusting member 3 can be performed.

It is also possible that the adjusting member 3 can be fixed onto any part, so that because of a movement of the movably mounted guide web 6 an adjustment or a movement can be performed, as on the components arranged at the ends 7 and 8 of the guide web 6 a repulsion force and/or attraction force act simultaneously. For this one or more moving parts are fastened or connected with one or both components arranged at the ends 7 or 8 of the guide web 6.

In the Figures described below examples of the use of such an actuating device 1 are described.

Figure 4:
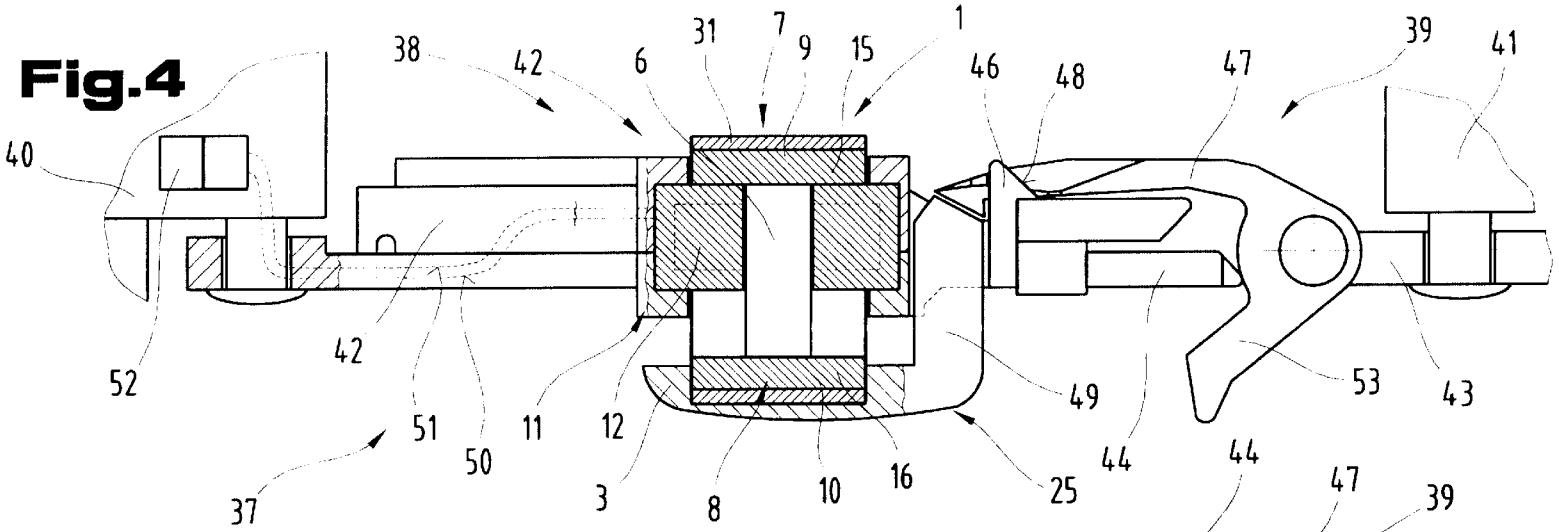
FIG. 4 an example of the application of the actuating device according to the invention in the form of a coupling device of a model railway vehicle in side view and partly in cross section and in a simplified, schematic view.
Figure 5:
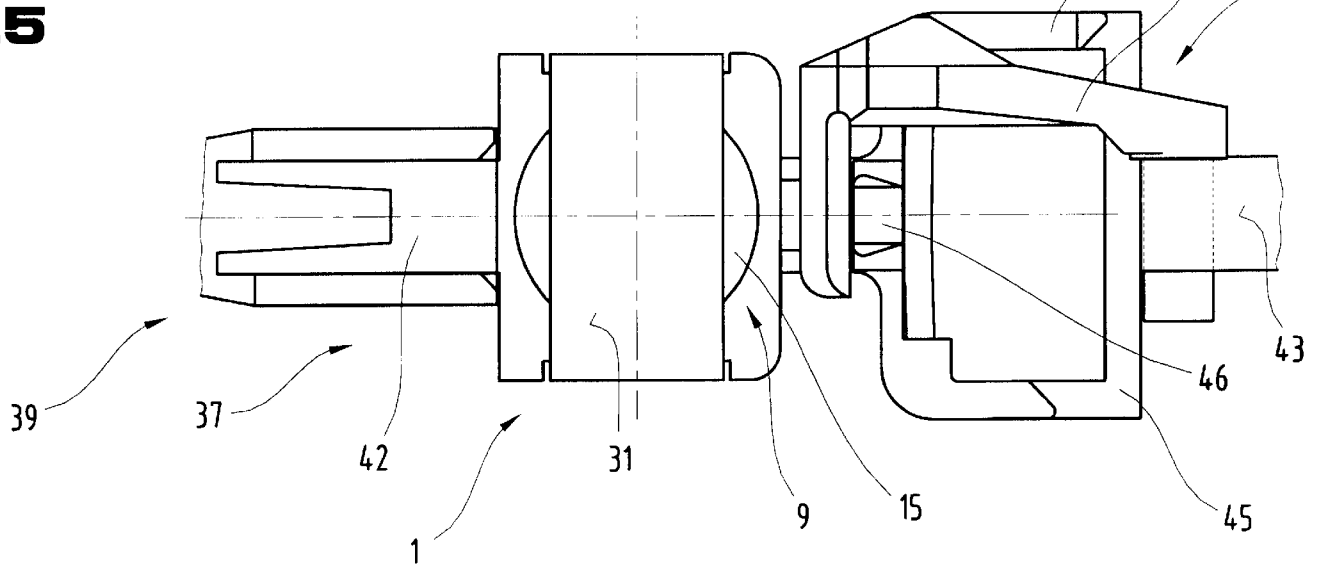
FIG. 5 a plan view of the example of application according to FIG. 4 in a simplified, schematic view.
Figure 6:
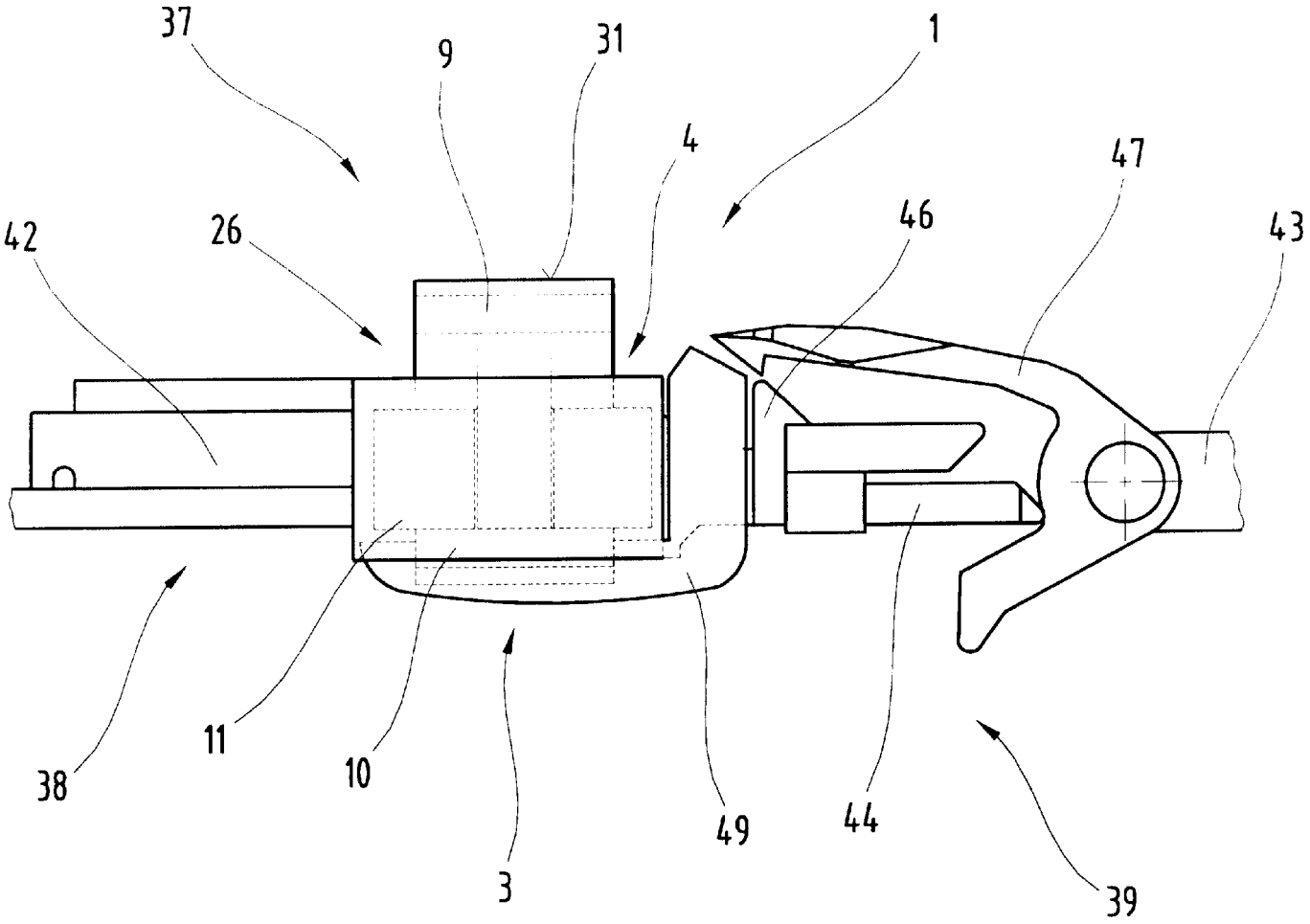
FIG. 6 the example of the application according to FIG. 4 of an activated actuating device according to the invention in a simplified, schematic view.

In FIGS. 4 to 6 an example of use of the actuating device 1 is shown in a simplified schematic view. This example of use relates to a coupling connection 37 of two coupling devices 38, 39 for connecting two model railway vehicles 40, 41. For this in FIG. 4 the coupling connection 37 is shown in side view and a simplified, schematic view with schematically indicated model railway vehicles 40, 41, whilst in FIG. 5 a plan view of the coupling connection 37 of the two coupling devices 38, 39 is shown without the model railway vehicles 40, 41. Furthermore, in FIG. 6 a side view of the coupling connection 37 is shown in an activated state, whereby in turn only the two coupling devices 38, 38 are shown.

In principle it should be mentioned that for such a coupling connection 37, each coupling system known from the prior art can be used for such an example of use, and is not restricted to the following embodiment variants of different coupling possibilities of two model railway vehicles 40, 41.

In the embodiments shown a coupling connection 37 is shown for example, in which the two coupling devices 38, 39 are of different construction. The two coupling devices 38, 39 have a main housing 42, 43 on which a coupling head 44, 45 is formed respectively. The main housing 42, 43 can be hinge connected for example by a rotary spindle with the model railway vehicles 40, 41, whereby it is possible that the coupling devices 38, 39 can be pivoted out when the model railway vehicles go round curves.

In order to permit the coupling together of the two coupling devices 38, 39, the coupling device 38 has a retainer 46 formed on the coupling head 44, whilst the other coupling device 39 has a pivot lever 47 which is hinge-mounted on the main housing 43. By means of such a system of a retainer 46 and a pivot lever 47 it is achieved that on driving together two model railway vehicles 40, 41, as already known from the prior art, the pivot lever 47 is raised over the retainer 46 by a surface 48 at an angle on the retainer 46 so that the pivot lever 47 falls behind the retainer 46 and thus is engaged with the retainer 46, whereby a secure coupling connection 37 of two model railway vehicles 40, 41 is formed. The precise functioning of the coupling of the two coupling devices 38, 39 is not explained in more detail, as this coupling connection 37 of the two coupling devices 38, 39 is already known from the prior art. Of course, it is possible that each coupling device 38, 39 comprises a retainer 46 and pivot lever 47, whereby however for this the individual parts have to be designed to be similar, so that a mutual engagement of the pivot levers 47 is possible behind the retainer 46.

So that an uncoupling of the two coupling devices 38, 39 can be performed, the actuating device 1 according to the invention is arranged in the coupling device 38, that is on each coupling device 38, 39, on which the retainer 46 is arranged. For this the actuating device 1, in particular the main body 4 is installed into the main housing 42 of the coupling device 38. Here that part, in particular the magnetic field producing component 11 is fixed onto the main housing 42 of the coupling device 38, whereby for the adjustment or for a movement sequence an adjustment of the parts at the ends 7 and 8, in particular the magnetic adjusting elements 9, 10, is performed via the guide web 6. For this for an adjustment or for a movement sequence a magnetic adjusting element 9 or 10 arranged at one end 7 or 8 by forming a repulsion force is pushed away from the fixed magnetic field producing component 11, whilst the magnetic adjusting element 9 or 10 arranged farther from the magnetic field producing component 11 by forming an attraction force supports the adjustment movement of the uncoupling lever 49.

So that an adjustment or movement sequence can be performed with the actuating device 1, on one of the two magnetic adjusting elements 9, 10, in particular with the magnetic adjusting element 10, the adjusting member 3 is arranged, whereby the adjusting member 3 forms an uncoupling lever 49. Said uncoupling lever 49 can be designed to be L-shaped, whereby the latter extends from the magnetic adjusting element 10 in the direction of the retainer 46. The L-shaped angled arm of the uncoupling lever 49 extends in engagement position of the pivot lever 47 in a free space behind the retainer 46, that is between the retainer 46 and the model railway vehicle 40 assigned to the coupling device 38.

In FIG. 4 the coupling connection 37 is shown in a deactivated state, whereas in FIG. 6 the coupling connection 37 is shown in an activated position.

So that the magnetic field producing component 11, in particular the coil 12, can be supplied with energy, the coil 12 is connected by connection lines 50, 51 with a control device 52 arranged in a model railway vehicle 40, whereby the charging of the magnetic field producing components 11 with energy is performed by the latter.

If now the magnetic field producing component 11 is charged with energy by the control device 52, the magnetic fields 22, 23 and 27 described in FIGS. 1 to 3 are formed between the magnetic adjusting elements 9, 10 and the magnetic field producing component 11, so that now an adjustment of the uncoupling lever 49 from the position of rest 25 shown in FIG. 4 to the working position 26 shown in FIG. 6 is performed by the vertical displacement of the magnetic adjusting elements 9, 10 along the guide web 6, whereby the pivot lever 47 of the other coupling device 39 is lifted over the retainer, so that during motion of at least one model railway vehicle 40, 41 an uncoupling of the coupling connection 37 is performed.

After the two model railway vehicles 40, 41 have moved away in particular the model railway vehicle 40, from model railway vehicle 41, a deactivation of the actuating device 1 can be performed by the control device 52, so that due to gravitational force a restoring of the actuating device 1 is performed, i.e. the uncoupling lever 49 is moved back from the working position 26, as shown in FIG. 6, into the position of rest 25, as shown in FIG. 4, by the weight of the uncoupling lever 49 and gravitational force by the vertical use of the actuating device 1. For this it is of course possible that by reversing the power on the magnetic field producing component 11 by reversing the magnetic fields 22, 23 and 27 support is possible on the restoring of the uncoupling lever 49 into the initial position, as already described in FIGS. 1 to 3.

Of course, it is possible that with such coupling connections 37 similar couplings can be used, so that by the control devices 52 arranged in the model railway vehicles 40, 41 an activation of the actuating device 1 in the coupling devices 37, 38 can be performed, so that a lifting of the pivot lever 47 of the other coupling device 38 or 39 is also performed, and thus uncoupling is possible at any point of a rail system.

In the embodiment shown it is also evident that on the pivot lever 47 an extension 53, which is aligned in the direction of the bearing surface of the model railway vehicles 40, 41, is arranged, so that also commercially available uncoupling systems, which are arranged on the rail body of model railway systems, can be used, i.e. that by driving over such an uncoupling system the pivot lever 47 is lifted by the extension 53, and thus in turn an uncoupling of the two coupling devices 38, 39 is achieved by lifting over the retainer 46.

Of course, it is possible to use any other design of adjusting member 3, in particular uncoupling lever 49. It is also possible that an exact design of the actuating device 1, as described in FIGS. 1 to 3, can be installed into such a coupling device 38. For this the adjusting member 3, in particular the uncoupling lever 49 is connected with the magnetic field producing component 11 or with a part of the actuating device 1, which is movably mounted on the guide web 6, so that by means of a corresponding adjustment of the movably mounted part on the guide web 6, as described in FIGS. 1 to 3, a lifting of the uncoupling lever 49 is achieved, and thus the lifting over of the pivot lever 47 of the other coupling device 39 over the uncoupling lever 49 can be performed. For this the magnetic adjusting elements 9, 10 arranged at the ends 7, 8 are connected to the main housing 42 or 43 of the coupling devices 37 or 38.

Figure 7:
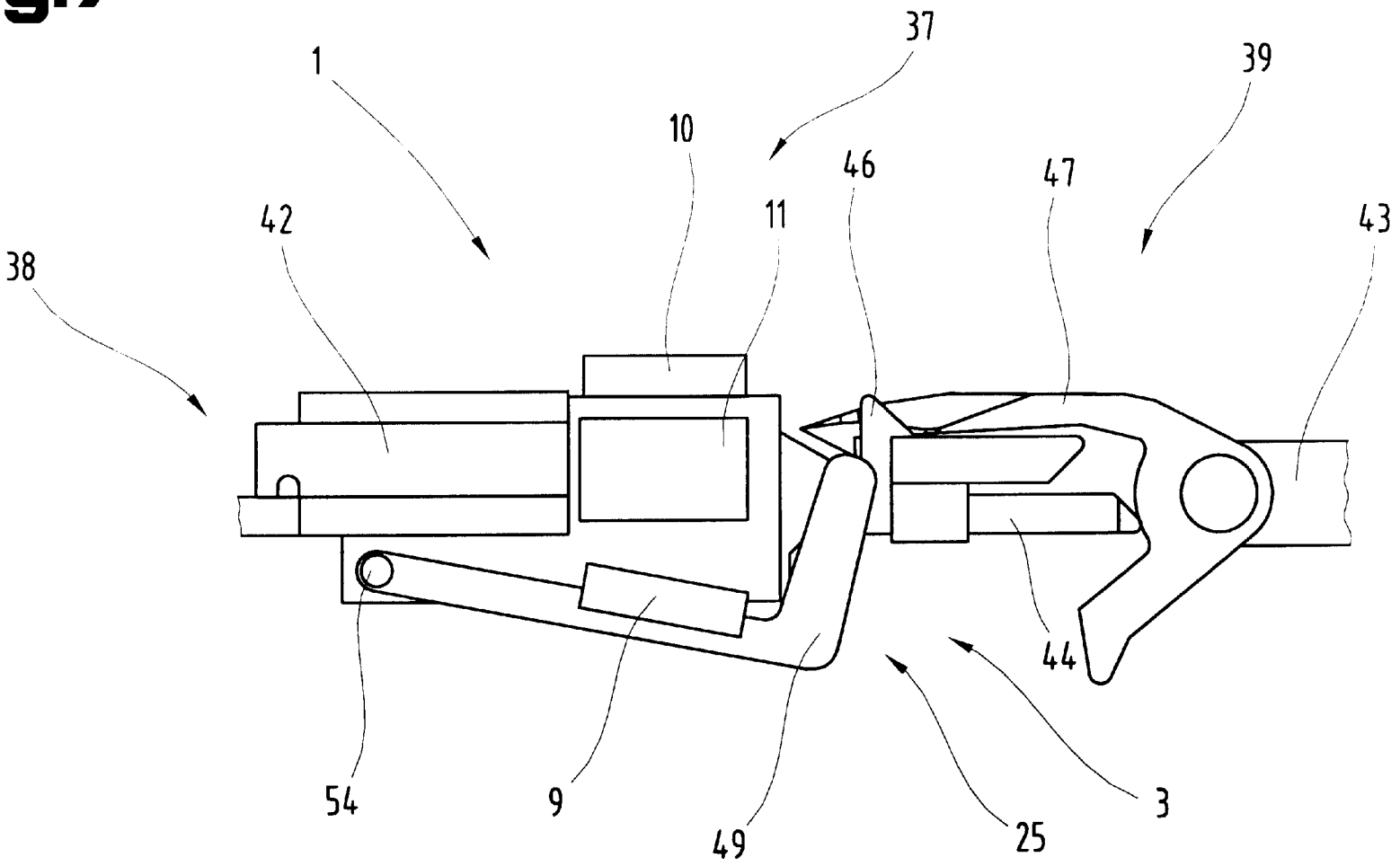
FIG. 7 a further embodiment of the actuating device according to the invention in the form of a coupling device of a model railway vehicle in side view and in a simplified, schematic view.

In FIG. 7 a further embodiment of the coupling connection 37 of two coupling devices 38, 39 is shown with the actuating device 1 arranged therein.

The two coupling devices 38, 39 are in turn formed from the individual parts as in the embodiments according to FIGS. 4 to 6. The difference from the embodiment shown in FIGS. 4 to 6 is that the actuating device 1 installed in the coupling device 38 is of a different design.

The actuating device 1 is here designed without a guide web 6, i.e. the uncoupling lever 49 is mounted by a pivot joint 54 on the main housing 42 of the coupling device 38, whereby however the actuating device 1 in turn is formed by the magnetic adjusting elements 9 and 10 and a magnetic field producing component 11. For this the magnetic field producing component 11 is arranged on the inside or in the main housing 42 of the coupling device 38, whereby the magnetic adjusting element 9 is arranged on the uncoupling lever 49 and is thus assigned to the magnetic field producing component 11.

So that a lifting of the pivot lever 47 of the other coupling device 39 is possible, the uncoupling lever 49 is mounted on the underside of the coupling device 38 by the pivot joint 54, i.e. the uncoupling lever 49, which is again L-shaped, is hinge connected on the side of the coupling device 38 of the rail system for model vehicles via the pivot joint 54 onto the main housing 42. For this it is advantageous that the pivot joint 54 for the uncoupling lever 49 is arranged between the actuating device 1 and the model railway vehicle 40 which for reasons of clarity is not shown, but is shown from the arrangement in FIG. 4. The actuating device 1 is arranged in turn between the retainer 46 and the pivot joint 54 or the model railway vehicle 40, whereby between the retainer 46 and the actuating device 1 a free space for the uncoupling lever 49 is formed, so that by the L-shaped design of the uncoupling lever 49 an arm of the latter can engage between the retainer 46 and the actuating device 1 in the free space.

With such a design of actuating device 1 it is achieved that by charging the magnetic field producing component 11 on the inside of the main housing 42 a magnetic field is produced, whereby the pole of this magnetic field has an opposite pole to the magnetic adjusting element 9 arranged on the uncoupling lever 49 and by the force of attraction between the two magnetic fields the uncoupling lever 49, in particular the adjusting member 3, is moved in the direction of the magnetic field producing component 11 so that the pivot lever 47 of the other coupling device 39 is lifted over the retainer 46 by the uncoupling lever 49.

So that the uncoupling lever 49 can be returned into the shown position of rest 25 it is possible that the power charging of the magnetic field producing component 11 is interrupted, so that due to gravitational pull a restoring of the uncoupling lever 49 is performed. Of course, it is possible that by reversing the polarity of the energy flow through the magnetic field producing component 11 a magnetic field reversal is performed, so that two identical poles of the magnetic fields of the magnetic field producing component 11 and the magnetic adjusting element 9 lie opposite one another and thus a repulsion force is created, whereby the uncoupling lever 49 is pushed away or is repulsed from the magnetic field producing component 11.

In such a design of the actuating device 1 it is also possible by an arrangement of an additional magnetic field producing adjusting element 10 on the opposite side of the uncoupling lever 49, to increase the attraction force by means of the permanently formed magnetic field.

It is also possible with such a coupling connection 37 to exchange the two parts, in particular the magnetic field producing component 11 and the magnetic adjusting element 9, whereby in turn by charging the magnetic component 11 the attraction force and repulsion force can be created from the uncoupling lever 49.

The advantage of such a coupling connection 37 with the actuating device 1 is that the two model railway vehicles 40, 41 can be uncoupled at any point of a rail system, whereby for this only a power charging of the magnetic field producing component 11 is required. This can be performed so that by the corresponding driving of the model railway vehicle 40 with a control signal the control device arranged therein performs an energy charging of the magnetic field producing component 11.

Figure 8:
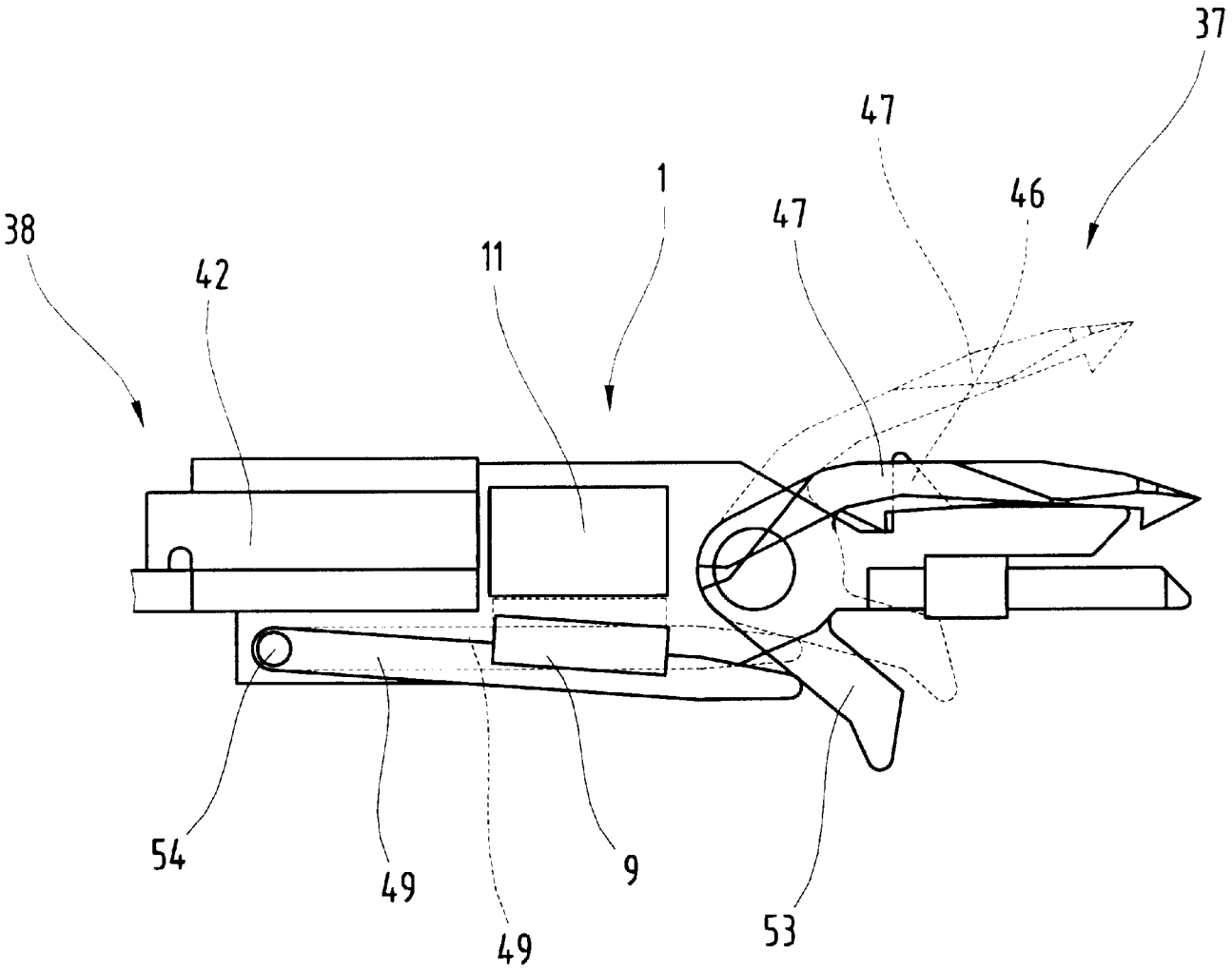
FIG. 8 a different embodiment of the actuating device according to the invention in the form of coupling device of a model railway vehicle in side view and in a simplified schematic view.

In FIG. 8 a further embodiment of a coupling connection 37 is shown, in which only a coupling device 38 is illustrated.

In this design of coupling device 38 the actuating device 1 is arranged in the coupling device 38, in particular in the main housing 42. The design of the actuating device 1 corresponds in this case to the previously described embodiment according to FIG. 7, i.e. instead of the guide web 6 the uncoupling lever 49 is arranged pivotably on the main housing 42 by the pivot joint 54. In this design of coupling device 38 in addition to the retainer 46 the pivot lever 47 is arranged on the coupling device 38. So that such a coupling device 38 can be coupled together with another coupling device 39 the other coupling device 39 is designed to be similar to said coupling device 38, whereby a gripping of the two pivot levers 47 of the coupling devices 38 and 39 behind the retainers 46 of the additional coupling devices 38 and 39 is possible.

So that such a coupling connection 37 can be detached, as in the aforementioned Figures, the magnetic field producing component 11 of the actuating device 1 needs to be charged with energy. Hereby it is achieved that the uncoupling lever 49 with the magnetic adjusting element 9 arranged thereon is moved in the direction of the magnetic field producing component 11, whereby due to the design of the uncoupling lever 49 the pivot lever 47 of the one coupling device 38 is lifted over the retainer 46 of the other coupling device 39.

This is achieved in that the uncoupling lever 49 is pressed onto the extension 53 arranged on the pivot lever 47, whereby due to the movement of the uncoupling lever 49 the pivot lever 47 is lifted over the retainer 46 and thus by a movement of the model railway vehicles 40, 41 the latter are uncoupled.

So that such a coupling connection 37 can be uncoupled, it is necessary for both coupling devices 38, 39 to have a corresponding actuating device 1 with the magnetic field producing component 11 and the magnetic adjusting element 9, so that by charging the magnetic field producing component 11 on both sides the attraction force for the uncoupling lever 49 is created, so that a motion sequence is performed corresponding to the embodiments described above.

The function of the actuating device 1 can be taken from the previously described Figures.

Figure 9:
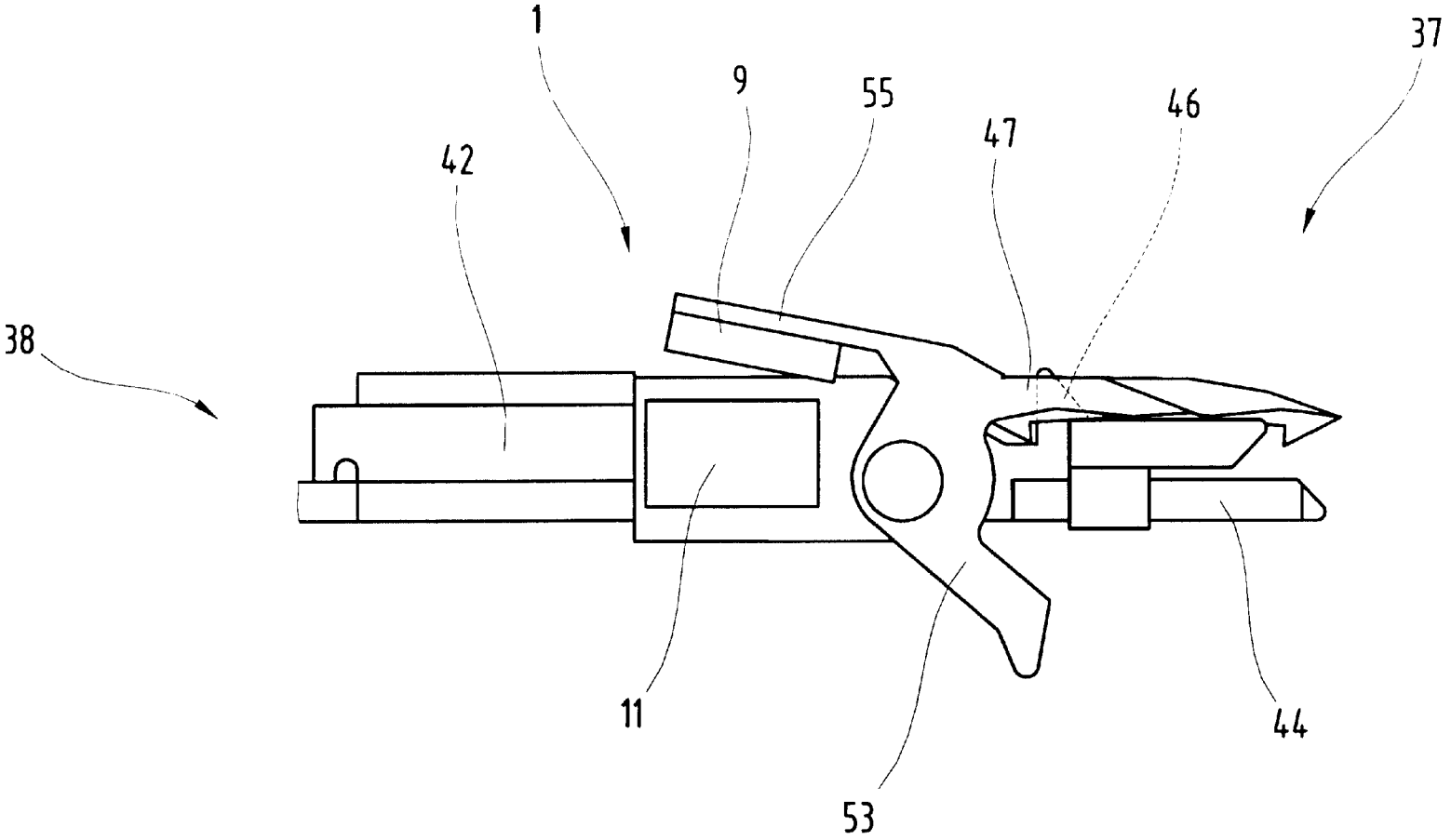
FIG. 9 a further embodiment of the actuating device according to the invention in the form of a coupling device of a model railway vehicle in side view and in a simplified, schematic view.

In FIG. 9 a further embodiment of a coupling device 38 for a coupling connection 37 between two model railway vehicles 40, 41 is shown. This embodiment corresponds to the embodiment described in FIG. 8, in which instead of an uncoupling lever 49 the pivot lever 47 with the extension 53 formed thereon has an additional actuating bar 55 formed on the pivot lever 47.

Of course, it is possible that the pivot lever 47 can be designed with the actuating bar 55 formed thereon to have several individual parts. The magnetic adjusting element 9 is arranged on the actuating bar 55, so that by arranging the magnetic field producing component 11 in the main housing 42 of the coupling device 38 the actuating device 1 is formed.

The actuating bar 55 can be designed to have any shape. In the shown embodiment the actuating bar 55 is arranged on the side opposite the extension 53, whereby the latter extends in the direction of the magnetic field producing component 11. In this way it is achieved, that due to the arrangement of the magnetic adjusting element 9 on the actuating bar 55 the main principle of the actuating device 1 is realised, i.e. due to the permanent magnetic field of the magnetic adjusting element 9 by charging the magnetic field producing component 11 with energy an attraction force or repulsion force can be created so that due to the movement of the actuating bar 55 in the direction of the magnetic field producing component 11 a lifting of the pivot lever 47 over the retainer 46 of the other coupling device 39 or 38 is performed, and thus a detachment of the coupling connection 37 of two couple devices 38, 39 occurs.

Figure 10:
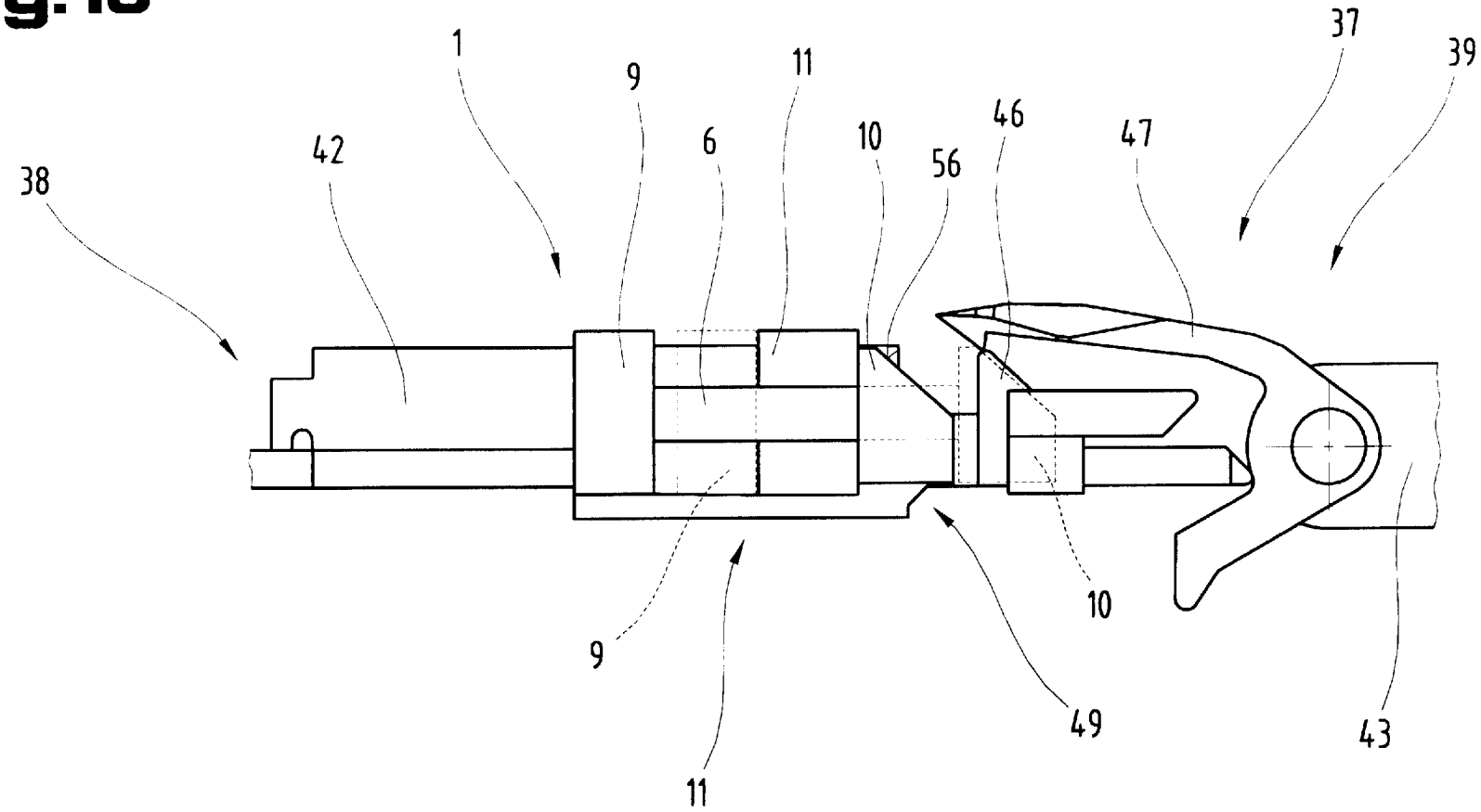
FIG. 10 a further embodiment of the actuating device according to the invention in the form of coupling device of a model railway vehicle in side view and in a simplified, schematic view.

In FIG. 10 a further embodiment of a coupling connection 37 of two coupling devices 38, 39 is shown. In this embodiment the two coupling devices 38 and 39 are designed according to the embodiments according to FIGS. 4 to 6, i.e. the coupling device 38 here comprises the retainer 46, whilst the pivot lever 47 is arranged on the other coupling device 39.

In the shown embodiment the coupled position of the two coupling devices 38, 39 is shown by solid lines, whilst the uncoupled position is shown by broken lines.

The actuating device 1 is here not designed in vertical direction to the bearing surface of the model railway vehicle 40, 41, but in horizontal direction, i.e. in the direction of the coupling device 38 or 39, whereby the actuating device 1 is formed from the magnetic field producing component 11 and the two magnetic adjusting elements 9, 10 coupled by the guide web 6.

For this the magnetic field producing component 11 is connected with the main housing 42 of the coupling device 38, whilst the two magnetic adjusting elements 9, 10 are mounted movably by the guide web 6 on the magnetic field producing component 11 and thus forms the adjusting member 3, in particular the uncoupling lever 49. By charging the magnetic field producing component 11 the two magnetic adjusting elements 9, 10 and the guide web 6 are moved in longitudinal direction of the coupling device 38 by the formation of the attraction force and the simultaneously formed repulsion force. So that a lifting of the pivot lever 47 of the other coupling device 39 is performed, the magnetic adjusting element 10 in the direction of the retainer 46 has an oblique running surface 56, so that by the horizontal movement of the magnetic adjusting element 10 the pivot lever 47 is lifted along the oblique running surface 56 over the retainer 46.

Of course, it is possible for the individual parts of the actuating device 1 to have any form. It merely has to be ensured that due to the horizontal movement of the actuating device 1 the pivot lever 47 of one or other coupling device 38 or 39 is lifted over the retainer 46.

In principle it should be mentioned that the use of such an actuating device 1 can be applied not only to coupling devices 38, 39 of model railway vehicles 40, 41, but that such an actuating device 1 can be used for any applications. It is also possible that such an actuating device 1 can have a drive for points of a model railway or can be used for other movement sequences, for example for miniaturised valves for liquids or the like.

Figures 11, 12, 13:
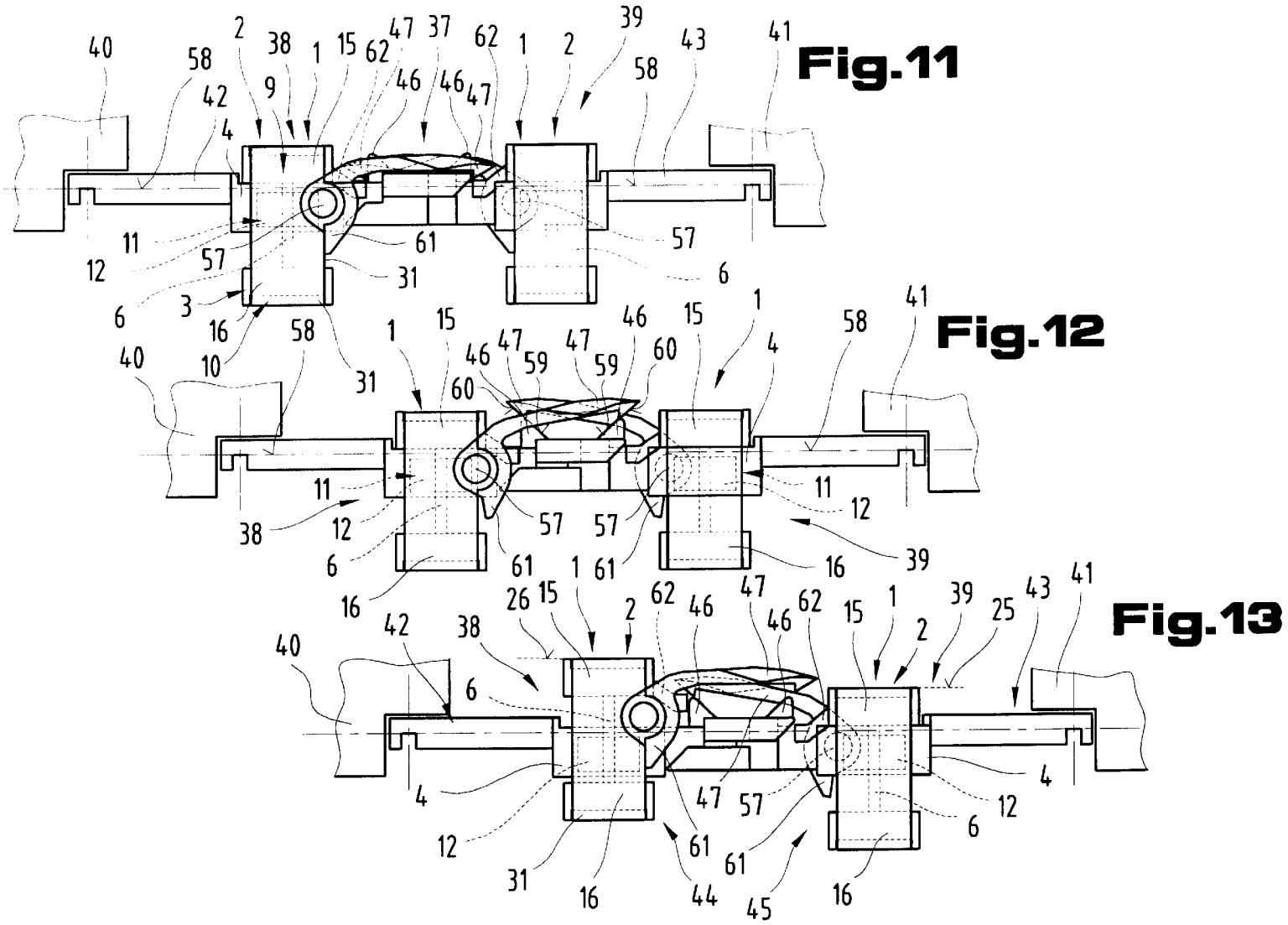
FIG. 11 the actuating device in application in a different embodiment variant of a coupling connection between model vehicles with coupling devices of identical structure with an active coupling connection in side view and in a simplified, schematic view.
FIG. 12 the electrically deactivated actuating devices of the two coupling devices according to FIG. 11 in a phase immediately before the formation of the coupling connection.
FIG. 13 the actuating devices and coupling devices according to FIGS. 11 and 12 in which to detach the coupling connection one of the actuating devices has been electrically activated.

In FIGS. 11 to 13 a further embodiment variant of an electromagnetic remote controllable coupling connection 37 between model vehicles, in particular between schematically indicated model railway vehicles 40, 41 is shown. Said coupling connection 37 comprises several parts, which have already been described in the above description, and said parts of the description can be applied to the same parts with the same reference numbers.

The coupling connection 37 comprises two coupling parts or coupling devices 38, 39 that are pivotably mounted on a model railway vehicle 40, 41, preferably about a vertical axis. Said coupling devices 38, 39 permit optionally the production of a coupling connection and a remote controllable uncoupling of the respective model railway vehicles 40, 41 without having to engage manually in the coupling connection 37.

The remote controlled adjustable components of the coupling connection 37 are in turn mounted adjustably relative to the main bodies 4 or on the main housings 42, 43 of the coupling connection 37. The main housing 42, 43 forms in one of its end regions the hinge connection with the corresponding model railway vehicle 40, 41, and in the opposite end region the electromagnetic actuating device 1 necessary for a remote-controlled adjustment of the coupling parts of the coupling connection 37 is arranged.

The shown design relates to a coupling connection 37, in which the coupling devices 38, 39 are designed to be identical on the model railway vehicles 40, 41 to be coupled or uncoupled. Despite the identical design of the coupling heads 44, 45 of the facing coupling devices 38, 39 on the model railway vehicle 40 and on the model railway vehicle 41 optionally both an unproblematic structure of a coupling connection 37 and a remote controllable detachment of the coupling connection 37 is permitted. This is achieved in that the pivot lever 47 is arranged off-centre in a plan view of the coupling device 38 or 39, i.e. to the side of the longitudinal middle axis 58.

The coupling connection 37 between the model railway vehicles 40, 41 can preferably be formed in the electrically inactive state of the two actuating devices 1. For the detachment of the coupling connection 37 preferably only one of the actuating devices 1 is charged for a relatively short period with electrical energy during the uncoupling process. In particular by the construction which is explained in more detail in the following only one of the two actuating devices 1 is supplied with electrical energy in order to disconnect the coupling connection 37.

Each of the identical coupling devices 38, 39 has the pin-like retainer 46 extending in vertical direction and the pivot lever 47 mounted pivotably about a horizontal pivot axis 57. The pin like retainers 46 are formed movement fast on the main housings 42, 43 or main bodies 4 or connected therewith. The retainers 46 can also be arranged off-centre to the longitudinal middle axis 58 of the respective coupling device 38 or 39, so that the retainers 46 with an active coupling connection 37 can be arranged next to one another in transverse direction relative to a longitudinal middle axis 58. In this way the retainers 46 projecting from the main housing 42 and 43 are moved past one another during a coupling procedure and in the coupled state overlap or overgrip at least partly in the direction of the longitudinal middle axis 58. Preferably only the pivot levers 47 of the coupling devices 38 or 39 are mounted off-centre of the main housing 42 or 43 and have in an opposite end region an offset pointing in the direction of the longitudinal middle axis 58. In this way the pivot levers 47 can be moved past one another and engage behind the retainer 46 of the respective other coupling device 38 or 39, when the coupling connection 37 is formed.

With an activated coupling connection 37 the pivot lever 47 of the first coupling device 38 grips behind the retainer 46 of the second coupling device 39. At the same time the pivot lever 47 of the second assigned coupling device 39 grips behind the retainer 46 on the first coupling device 38. In this way a so-called double hook coupling with double engagement is formed, starting from the first coupling device 38 and from the second coupling device 39. This produces a reliable coupling connection 37 between model railway vehicles 40, 41, which also excludes at high tensile forces an undesired detachment of the coupling connection 37. The main advantage of this coupling device 37 is that despite the identical construction of the coupling devices 38, 39 a coupling connection can be formed, and therefore the alignment or the last direction of travel is not significant for the formation of the coupling connection 37, and thus does not represent an obstacle to coupling.

By means of this coupling device 38, 39 it is also possible to produce a coupling connection 37 with the front and the rear end of a model railway vehicle 40, 41. This is achieved in that each coupling device 38 and 39 comprises the retainer 46 and the pivot lever 47, and at least the pivot levers 47 are arranged off-centre relative to the longitudinal middle axis 58 of the coupling devices 38, 39, so that the latter during the coupling procedure can be guided past one another laterally.

The retainer 46 and/or the pivot lever 47 has an oblique angled running surface 59, 60. The running surface 59 on the retainer 46 and a running surface 60 in the end region of the pivot lever 47 opposite the pivot axis 57 run relative to only one coupling device 38 or 39 in opposite directions or at an angle to one another. If a coupling device 38 or 39 is observed, the running surfaces 59 and 60 provided on the coupling device 38 or 39 run indifferent dimensions. In particular the running surface 59 and/or 60 on the retainer 46 and/or on the pivot lever 47 extends parallel to its pivotal axis 57 and is thus inclined to the longitudinal middle axis 58 of the coupling device 38, 39, i.e. from 0° or 90°. Said running surfaces 59, 60 ensure that on a relative movement of the coupling devices 38, 39 to one another the pivot levers 47 are lifted or pivoted about the pivotal axes 57 and after sufficient relative adjustment at the end of the running surfaces 59 fall down by the effect of gravity and can engage behind the retainer 46 of the other coupling device 38 or 39, and in this way can form a positive coupling connection 37.

It is essential in the shown coupling devices 38, 39, that the actuating device 1 forms a drive 2 for an adjusting movement in vertical direction. The actuating device 1 comprises the guide web 6 adjustable in vertical direction relative to the main housing 42, 43 or main housing 4, with the magnetic adjusting elements 9,10 arranged on its two end regions, in particular in the form of permanent magnets 15, 16. The guide web 6 due to the relative adjustability in vertical direction, also termed as the adjusting member 3, has in its outer circumferential region an at least partly magnetic field increasing element, in particular the rear closing plate 31. The guide web 6 also ensures that the adjusting movement of the adjusting member 3 relative to the main body 4 can be performed only linearly and in one direction, e.g. is possible only in vertical direction.

The magnetic field producing component 11 or the coil 12 of the actuating device 1 is mounted non-displaceably in the main housing 42, 43. The adjusting member 3 or the corresponding guide web 6 with the magnetic adjusting elements 9, 10 fixed thereon is guided adjustably in vertical direction relative to the fixed, magnetic field producing component 11 or coil 12. As soon as the coil 12 is charged with electrical energy, as previously explained the corresponding attraction and repulsion forces for performing the adjustment movement of the adjusting member 3 relative to the main body 4 or to the coil 12 are created. The coil 12 is understood to be an optionally activatable or swicthable magnetic field producing component 11, in particular in the form of a magnetic coil.

It is essential that the pivot axis 57 for the pivot lever 47 on the adjusting member 3 or on the guide web 6 is designed so that the pivot axis 57 is adjustable in vertical direction.

In this way in particular the pivot axis 57 on the energy charging of the actuating device 1 can also be adjusted upwards in vertical direction and in this way lifts the entire pivot lever 47 in vertical direction.

In addition, the pivot lever 47 has an extension 61 which acts as a stop, and delimits a pivot movement of the pivot lever 47 about the pivot axis 57 in downwards direction or gravitational direction. In the stop delimited position of the pivot lever 47 the extension 61 or a corresponding stop preferably rests on a surface of the adjusting member 3 or the guide web 6 and prevents a pivotal movement of the pivot lever 47 to the bottom dead centre.

As the pivotal movement of the pivot lever 47 is delimited in downwards direction by the extension 61 and a corresponding stop surface, the entire pivot lever 47 on activating the actuating device 1 by means of electrical energy, can be lifted in vertical direction, until the latter is out of engagement with the assigned retainer 46. As a result of this with a relative movement of one of the two coupling devices 38, 39 in the direction of their longitudinal middle axes 58 the coupling connection 37 can be lifted.

In addition on the relatively moveable adjusting member 3 or guide web 6 a carrier 62 is arranged or is motion connection with the guide web 6 or with the adjusting member 3. Said carrier 62 is arranged so that the pivot lever 47 of the assigned additional coupling device 39 is engaged underneath. In this way it is achieved that on activating one of the actuating devices 1 the pivot lever 47 assigned to this actuating device 1 is moved translatorily upwards in vertical direction, and at the same time the pivot lever 47 of the other assigned coupling device 39 is pivoted by the carrier 62 and in this way can also be moved out of engagement with the assigned retainer 46.

To summarise it may be said that on activating only one of the two actuating devices 1 one of the two pivot levers 47 is pivoted translatorily in vertical direction upwards and the second pivot lever 47 is pivoted rotarily by the carrier 62, and in this way both pivot levers 47 are displaced simultaneously out of engagement with the respective retainers 46.

FIG. 11 shows the two coupling devices 38, 39 in an active coupling connection 37, whilst FIG. 12 shows a phase immediately before the formation of the coupling connection 37 between the coupling devices 38, 39. Here the two electromagnetic actuating devices 1 are inactive, i.e. without current charge. The two coupling devices 38, 39 move towards one another in the direction of the longitudinal middle axes 58 and stand immediately in front of the positive connection by means of the retainers 46 and pivot levers 47.

FIG. 13 shows an activated actuating device 1, i.e. charged with electrical energy, whereupon which the adjusting member 3 or the guide web 6 adopts the upper end position of the possible adjustment range. As can clearly be seen in the drawing the two pivot levers 47 are moved and placed out of engagement with the assigned retainers 46. It is clearly evident here that a vertical movement of the adjusting member 3 or the guide web 6 causes a lifting of the pivot axis 57 and the pivot lever 47 mounted thereon, and at the same time a pivoting of the pivot lever 47 of the other coupling device 39 about its pivot axis 57 is achieved by means of the carrier 62 moved in vertical direction. In the uncoupling phase shown in FIG. 13 it is merely necessary to move away at least one of the two coupling devices 38, 39 in the direction of their longitudinal middles axes 58 from the adjacent coupling device 38 or 39. Afterwards the electrical activated actuating device 1 can be deactivated immediately, i.e. moved into the currentless state, whereupon the coupling device 38 or 39 is again immediately ready to form a new coupling connection 37.

Equally uncoupling is possible, when the actuating device 1 of the other coupling device 39 is activated or even if both actuating devices 1 are set simultaneously into the active or working position 26.

Figure 14:
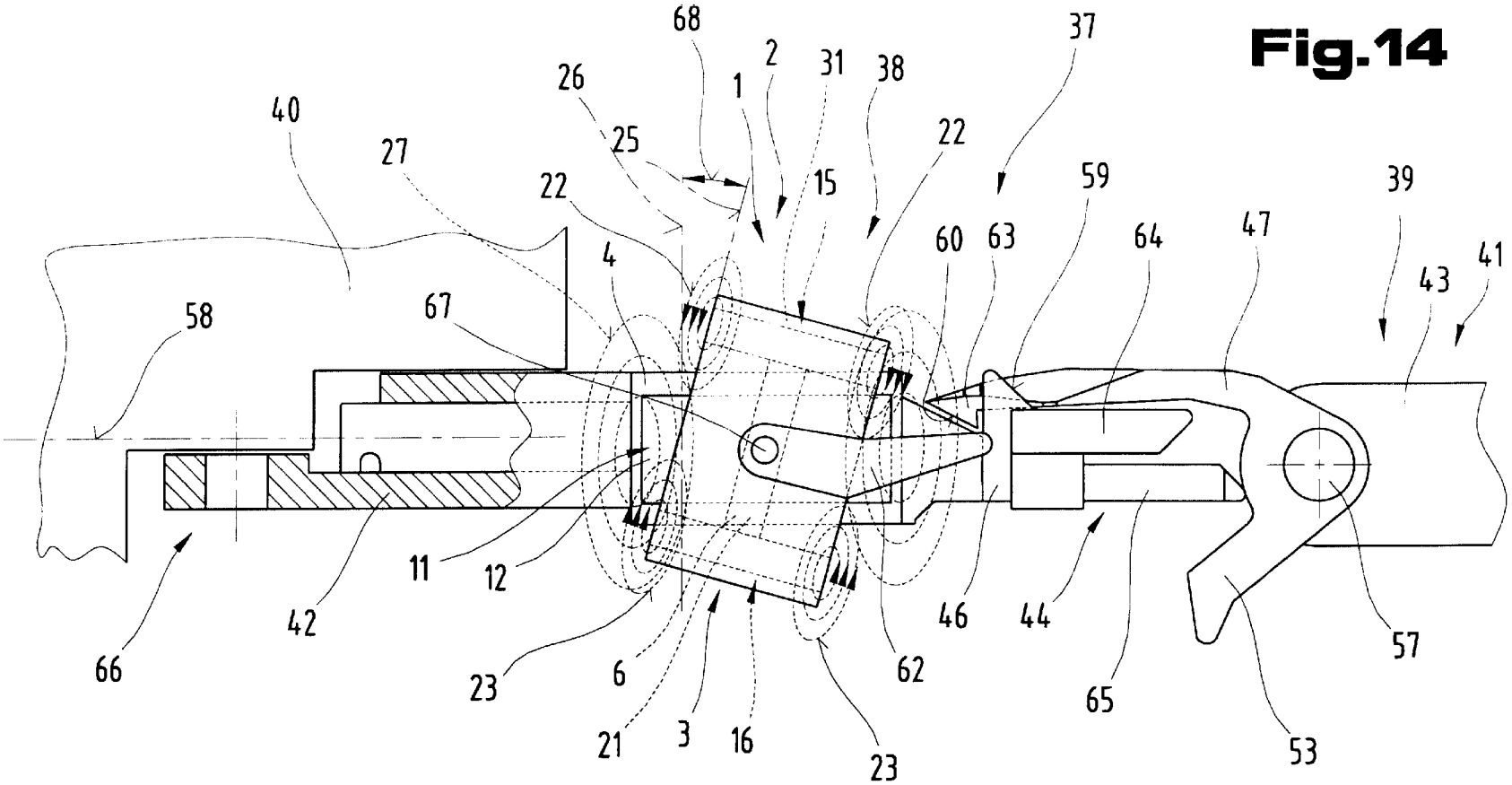
FIG. 14 a further embodiment of an actuating device in application with coupling devices for an optionally activatable and deactivatable coupling connection between model vehicles in side view and in a much simplified schematic view.

FIG. 14 shows a further embodiment variant of a remote controllable, electromagnetic adjustable coupling connection 37 between corresponding coupling devices 38, 39 on two model railway vehicles 40, 41.

The model railway vehicle 40 comprises the pivot lever 47 rotatably mounted about the pivot axis 57 with an offset hook-shaped end in the end region opposite the pivot axis 57. In order to grip behind the retainer 46 of the other coupling device 38 on the other model railway vehicle 40 the pivot lever 47 has in the end region opposite the pivot axis 57 said offset or the corresponding holding web 63 aligned parallel to the pivot axis 57, as shown in particular in FIG. 5 from above. On said holding web 63 running parallel to the pivot axis 57 the running surface 60 is also formed in order to lift the pivot lever 47 to form the coupling connection 37 slidingly over the retainer 46.

In addition, the coupling device 38 comprises the coupling head 44 with at least two fork-shaped extensions running in the direction of the longitudinal middle axis 58 between which the retainer 46 projects upwards in vertical direction.

The electromagnetic drive or the actuating device 1 is mounted with respect to the longitudinal middle axis 58 between the fork-shaped coupling head 44 with the retainer 46 projecting in vertical direction and the hinge connection 66 to the model railway vehicle 40.

The unit comprising the actuating device 1 and coupling head 44 is preferably inserted positively into the main housing 42 or 43 and in this way if necessary is replaceably mounted so that the latter can be replaced by a different type of coupling device which is constructed for example without an electromagnetic drive 2.

For this the coupling head 44 with the actuating device 1 or the drive 2 can be moved by corresponding, form-closed elevations and depressions out of engagement with the main housing 42.

It is essential here that the adjusting member 3 or the guide web 6 with the permanent magnets 15, 16 arranged in its end regions and the rear closing plate 31 surrounding these components is mounted rotarily about a pivot axis 67 relative to the main housing 42 or to the coupling device 38. The coil 12 however is fixed immobily in the coupling device 38 or in the main body 4.

The pivot axis 67 for pivoting the adjusting member 3 or the guide web 6 with the permanent magnets 15, 16 relative to the fixed coil 12 runs at right angles to the longitudinal middle axis 58 of the coupling device 38 in a horizontal plane. In the initial state or in the position of rest 25 the adjusting member 3 is inclined relative to the longitudinal middle axis 58, i.e. the adjusting member 3 or the guide web 6 without energy charging adopts an oblique position at an angle of inclination 68 to the vertical. Said oblique position to the vertical is preferably maintained by a corresponding weight shift of the adjusting member 3, i.e. by the effect of gravity. Of course, it is also possible to maintain this oblique position in the angle of inclination 68 by a mechanical force storing device, in particular a type of spring elastic tensioning device in the form of a spring or the like.

On charging the magnetic coil or the coil 12 with electrical energy, the adjusting member 3 or the guide web 6 due to the switched electromagnetic forces of the coil 12 is mainly perpendicular so that the angle of inclination 68 is almost zero. The optional switchable electromagnetic forces of the coil 12 thus produce a pivoting of the adjusting member 3 or the guide web 6 about its pivot axis 67, so that the guide web 6 is aligned parallel to the vertical and here is moved into the working position 26, i.e. into the end coupling position.

For the uncoupling the adjusting member 3 or the guide web 6 has the carrier 62 which projects from the adjusting member 3. On pivoting the adjusting member 3 about the pivot axis 67 the carrier 62 acting as a lever pivots together with the adjusting member 3 about the pivot axis 67. Once the carrier 62 undergrips the pivot lever 47 or its holding web 63 the adjusting member 3 and the pivot lever 47 are motion-coupled, so that on the pivoting of the adjusting member 3 or the guide web 6 the pivot lever 47 is pivoted up and in this way can be disengaged from the retainer 46. The carrier 62 undergrips the pivot lever 47 preferably on its running surface 60.

A charging of the actuating device 1 with electrical energy thus produces a pivoting of the adjusting member 3 about the pivot axis 67 and then a pivoting of the motion coupled pivot lever 47 for lifting the holding web 63 over the retainer 46, so that the coupling connection 37 can be lifted on a movement of one of two coupling devices 38 or 39 relative to one another.

At least one intended extension of the pivot axis 67 for the adjusting member 3 runs preferably at right angles to the longitudinal middle axis 58 of the coupling devices 38 through the coil 12. The guide web 6 hereby forms a coil core 21 that is pivotable in the coil centre.

Since the field lines or the magnetic fields 22, 23 of the permanent magnets 15, 16 are always aligned parallel to the field lines of the magnetic field 27 of the electrically charged magnetic coil, the adjusting member 67 is moved by the switched electromagnetic forces into the working position 26 or into a vertical position, and afterwards the coupling connection 37, can be lifted, and if necessary can be completely separated by the previously mentioned relative movement.

On a deactivation of the magnetic field 27 by interrupting the current supply to the magnetic field producing component 11 or to the coil 12, the adjusting member 3 or the guide web 6 tilts by the effect of gravity or a spring force automatically back into its shown initial position or position of rest 25.

For form's sake it is noted that for a better understanding of the structure of the actuating device 1 and the coupling device 38, 39 the latter and its components are illustrated partly untrue to scale and/or enlarged and/or reduced. The objective underlying the independent inventive solutions can be taken from the description.

Primarily the individual embodiments shown in FIGS. 1, 2, 3, 4, 5, 6, 7, 8, 9, 10, 11, 12, 13, 14 can form the subject matter of independent solutions according to the invention. The objectives and solutions according to the invention are taken from the detailed descriptions of these Figures.

LIST OF REFERENCE NUMBERS

1. Actuating device
2. Drive
3. Adjusting member
4. Main body
5. Arrow
6. Guide web
7. End
8. End
9. Magnetic adjusting element
10. Magnetic adjusting element
11. Magnetic field producing component
12. Coil
13. Coil body
14. Connection
15. Permanent magnet
16. Permanent magnet
17. South pole
18. South pole
19. North pole
20. North pole
21. Coil core
22. Magnetic field
23. Magnetic field
24. Magnetic field lines
25. Position of rest
26. Working position
27. Magnetic field
28. South pole
29. North pole
30. Magnetic field lines
31. Rear closing plate
32. Magnetic-field producing component
33. Coil
34. Coil body
35. Part
36. Part
37. Coupling connection
38. Coupling device
39. Coupling device
40. Model railway vehicle
41. Model railway vehicle
42. Main housing
43. Main housing
44. Coupling head
45. Coupling head
46. Retainer
47. Pivot lever
48. Surface
49. Uncoupling lever
50. Connection line
51. Connection line
52. Control device
53. Extension
54. Rotary joint
55. Activating bar
56. Surface
57. Pivot axis
58. Longitudinal middle axis
59. Running surface
60. Running surface
61. Extension
62. Carrier
63. Holding web
64. Extension

65. Extension

66. Hinge connection

67. Pivot axis

68. Angle of inclination

What is claimed is:

1. A coupling device for mounting on a first model railway vehicle to couple the first model railway vehicle to a second model railway vehicle also having a device for coupling, comprising:

a main housing;

an electromagnetic drive comprising a stationary member fixed on the main housing and an actuating member connected to the stationary member for relative displacement with respect thereto along an axis, the drive further including first and second magnetic members spaced a distance apart along a direction parallel to said axis and a third magnetic member disposed between the first and second magnetic members, at least one of the magnetic members comprising a magnetic-field producing component in the form of a coil for generating a magnetic field when current is supplied through the coil, the first and second magnetic members being mounted on one of the stationary and actuating members and the third magnetic member being mounted on the other of the stationary and actuating members, the three magnetic members being arranged such that activating the drive causes a magnetic repulsion force on one side of the third magnetic member and a magnetic attraction force on an opposite side of the third magnetic member so as to effect the relative displacement between the stationary member and the actuating member; and a magnetic closing plate arranged about an outside of the magnetic members and operable to concentrate magnetic field lines thereof toward the third magnetic member;

whereby activating the electromagnetic drive causes a pivot lever of at least one of the model railway vehicles to be displaced.

2. The coupling device according to claim 1, wherein the coil surrounds a guide web for guiding the relative displacement between the stationary and actuating members, and wherein the guide web and the magnetic closing plate collectively act to concentrate magnetic field lines of the coil.

3. The coupling device according to claim 1, wherein each of the first and second magnetic members comprises a permanent magnet.

4. The coupling device according to claim 1, wherein the magnetic field producing component is arranged in the actuating member.

5. The coupling device according to claim 1, wherein the actuating member is displaceable along a guide web and is displaced by supplying current through the magnetic-field producing component.

6. The coupling device according to claim 5, wherein the guide web forms a coil core for the magnetic-field producing component.

7. The coupling device according to claim 6, wherein the first and second magnetic members are mounted on opposite ends of the guide web.

8. The coupling device according to claim 7, wherein the first and second magnetic members are connected with the guide web such that identical poles thereof face the guide web.

9. The coupling device according to claim 1, wherein the actuating member forms a coupling part for the coupling device configured to engage the device for coupling on the second model railway vehicle.

10. The coupling device according to claim 1, wherein the coupling device includes a guide web on which the third magnetic member comprising a permanent magnet is arranged, and wherein the first and second magnetic members are arranged at the two ends of the guide web, the coil constituting the first magnetic member, and the second magnetic member also being a coil.

11. The coupling device according to claim 10, wherein on charging both coils an independent magnetic field is formed by each coil, whereby the polarity of the two magnetic fields is directed in such a way that on facing regions of the coils an identical pole is formed.

12. The coupling device according to claim 1, wherein the actuating member of the coupling device forms an uncoupling lever of the coupling device.

13. The coupling device according to claim 1, wherein the actuating member of the coupling device forms an actuating bar of the coupling device.

14. The coupling device according to claim 1, wherein the coupling device includes a pivot lever connected to the actuating member and pivotable about a horizontally aligned pivot axis that is perpendicular to a longitudinal middle axis of the coupling device, and wherein the axis along which the actuating member is displaced is oriented vertically such that the pivot axis of the pivot lever is adjustable in vertical direction.

15. The coupling device according to claim 14, wherein the pivot lever has an extension for limiting the pivotability about the pivot axis in gravitational direction downwards.

16. The coupling device according to claim 15, wherein the extension in a stop limited position of the pivot lever bears on a surface of the coupling device.

17. The coupling device according to claim 14, wherein the actuating member is mounted pivotably about a pivot axis relative to the main housing of the coupling device.

18. The coupling device according to claim 17, wherein the pivot axis between the actuating member and the main housing is aligned parallel to the pivot axis of the pivot lever.

19. The coupling device according to claim 17, wherein the electromagnetic coil is annular and encircles a guide web of the actuating member, wherein the coil is fixed in the main housing and an extension of the pivot axis of the actuating member runs through the electromagnetic coil and the guide web forms a coil core that is pivotable in the centre of the annular coil.

20. The coupling device according to claim 19, wherein the magnetic closing plate surrounds the guide web and the coil at least partly in an outer circumferential region thereof.

21. The coupling device according to claim 17, further comprising a carrier on the pivotably mounted actuating member, the carrier being structured and arranged to slidingly engage under a pivot lever of another coupling device on the second model railway vehicle.

22. The coupling device according to claim 17, wherein the actuating member in a position of rest not charged with electrical energy adopts an angle of inclination relative to a vertical plane.

23. The coupling device according to claim 17, wherein the actuating member in the energy charged state of the coupling device is directed opposite the effect of gravity or a spring force mainly parallel to a vertical plane.

24. The coupling device according to claim 1, further comprising a carrier arranged on the coupling device such that the carrier engages under a pivot lever of a second coupling device when the coupling device is coupled to the second coupling device.

25. The coupling device according to claim 24, wherein the carrier is designed for lifting a hooked-shaped end region of the pivot lever of the second coupling device.

26. The coupling device according to claim 24, wherein the carrier is connected to the actuating member such that activation of the coupling device causes the carrier to lift upwardly and raise the pivot lever of the second coupling device.

* * * * *